US009334071B2

(12) United States Patent
Tommasi

(10) Patent No.: US 9,334,071 B2
(45) Date of Patent: May 10, 2016

(54) APPARATUS AND METHOD FOR PACKAGING STACKS OF FOLDED TISSUE PRODUCTS AND THE LIKE WITH A PLASTIC FILM

(75) Inventor: Renzo Tommasi, Montecatini Terme (IT)

(73) Assignee: RENT S.R.L., Massa e Cozzile (Pistoia) (IT)

( * ) Notice: Subject to any disclaimer, the term of this patent is extended or adjusted under 35 U.S.C. 154(b) by 698 days.

(21) Appl. No.: 13/698,133

(22) PCT Filed: May 30, 2011

(86) PCT No.: PCT/IB2011/052363

§ 371 (c)(1), (2), (4) Date: Jan. 24, 2013

(87) PCT Pub. No.: WO2011/151774

PCT Pub. Date: Dec. 8, 2011

(65) Prior Publication Data

US 2013/0111856 A1 May 9, 2013

(30) Foreign Application Priority Data

May 31, 2010 (IT) ..... FI2010A0120

(51) Int. Cl.

| | |
|---|---|
| ***B65B 11/28*** | (2006.01) |
| ***B65B 9/00*** | (2006.01) |
| ***B65B 11/30*** | (2006.01) |
| ***B65B 25/14*** | (2006.01) |
| ***B65B 63/02*** | (2006.01) |

(52) U.S. Cl.

CPC . *B65B 9/00* (2013.01); *B65B 11/30* (2013.01); *B65B 25/145* (2013.01); *B65B 63/02* (2013.01)

(58) Field of Classification Search

CPC ..... B65B 11/28; B65B 11/30
USPC ..... 53/511, 452, 466, 574, 578, 579
See application file for complete search history.

(56) References Cited

U.S. PATENT DOCUMENTS

| | | | | | |
|---|---|---|---|---|---|
| 1,653,908 | A | * | 12/1927 | Hunt | 53/541 |
| 4,367,618 | A | * | 1/1983 | Focke | 53/234 |
| 4,662,155 | A | * | 5/1987 | Chasman | 53/433 |
| 4,747,250 | A | * | 5/1988 | Rossi | 53/511 |
| 4,845,924 | A | | 7/1989 | Focke et al. | |

(Continued)

FOREIGN PATENT DOCUMENTS

| | | | |
|---|---|---|---|
| DE | 2439192 | A1 | 3/1976 |
| EP | 0553636 | A1 | 8/1993 |

(Continued)

*Primary Examiner* — Gloria R Weeks
(74) *Attorney, Agent, or Firm* — Lucas & Mercanti, LLP.

(57) ABSTRACT

An apparatus for packaging stacks of folded tissue products or the like with blanks of plastic film, having at least one pocket, an insertion device for inserting, along an insertion direction, a single stack in the at least one pocket with the interposition and consequent folding of a corresponding blank, the at least one pocket being operatively associated with a stop member of the stack completely inserted within the pocket. The apparatus also has a control system adapted to operate the stop member in a coordinated manner with respect to the operation of the insertion device, to provide an abutment to the stack during the whole insertion step in the pocket, the stop member having suction devices to keep the film in position and to disengage the same film at least in an extraction step of the stack from the pocket.

15 Claims, 18 Drawing Sheets

(56) References Cited

U.S. PATENT DOCUMENTS

| | | | | |
|---|---|---|---|---|
| 5,459,979 | A * | 10/1995 | Tommasi | 53/439 |
| 5,533,323 | A * | 7/1996 | Osti et al. | 53/466 |
| 5,943,840 | A * | 8/1999 | Nilsson et al. | 53/133.2 |
| 5,996,309 | A * | 12/1999 | Focke et al. | 53/228 |
| 6,000,196 | A * | 12/1999 | Boldrini et al. | 53/410 |
| 6,305,146 | B1 * | 10/2001 | Gerber | 53/116 |
| 6,601,365 | B2 * | 8/2003 | Arishiro et al. | 53/54 |
| 6,601,369 | B2 * | 8/2003 | Spatafora et al. | 53/466 |
| 6,840,025 | B1 * | 1/2005 | Chapman | 53/475 |
| 2009/0288371 | A1 * | 11/2009 | Squarzoni et al. | 53/456 |
| 2012/0208686 | A1 * | 8/2012 | Iwasa et al. | 493/162 |

FOREIGN PATENT DOCUMENTS

| | | | |
|---|---|---|---|
| EP | 1260442 | A2 | 11/2002 |
| EP | 1262409 | A2 | 12/2002 |

* cited by examiner

FIG. 6
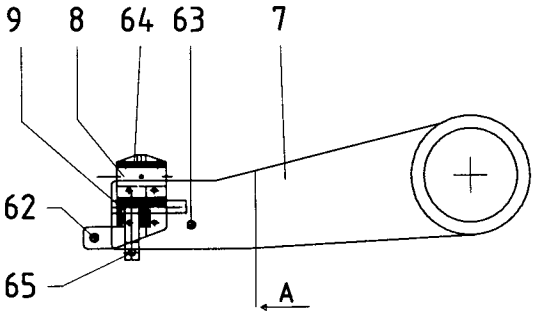
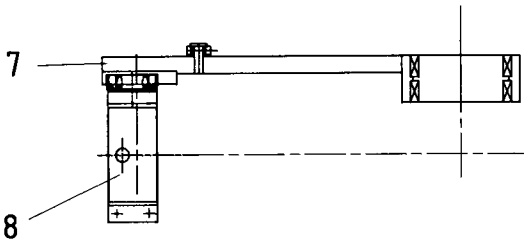
FIG. 7
FIG. 4
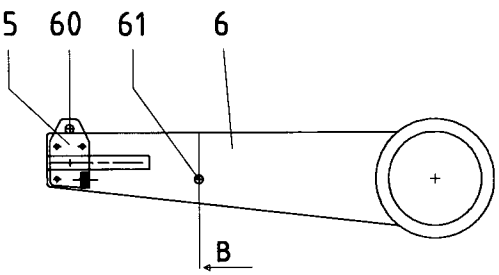
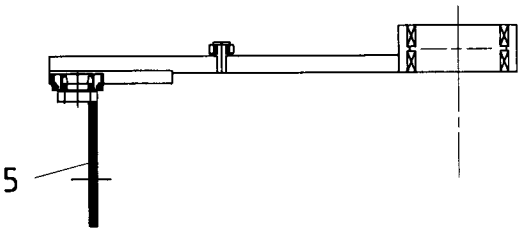
FIG. 5

APPARATUS AND METHOD FOR PACKAGING STACKS OF FOLDED TISSUE PRODUCTS AND THE LIKE WITH A PLASTIC FILM

CROSS-REFERENCE TO RELATED APPLICATIONS

This application is a 371 of PCT/IB2011/052363, filed May 30, 2011, which claims the benefit of Italian Patent Application No. FI2010A000120, filed May 31, 2010, the contents of each of which are incorporated herein by reference.

TECHNICAL FIELD OF THE INVENTION

The present invention concerns the packaging of stacks of folded tissue items such as handkerchiefs, napkins and the like with a wrapper made from weldable plastic film, for example but not exclusively through revolving drum machines.

BACKGROUND OF THE INVENTION

Known machines or apparatuses of this type are of the kind described in U.S. Pat. No. 4,845,924 and U.S. Pat. No. 5,459,979. In brief, these are high speed packaging machines, comprising a drum provided with radial pockets with dimensions that are suitable for the product to be packaged, inside which the stacks of product to be packaged are inserted in rapid succession, with the simultaneous interposition of one blank plastic film, so as to obtain the complete wrapping of each stack, completed by welding applied on the film to obtain a closed packaging.

In machines of this kind, due to the high operation speed that is required to ensure suitable productivity, it is very complex to compress the stack, keep its correct geometry and carry out the insertion inside the pockets of the drum without causing deformations or faults in the wrapping by the film. In particular, but not exclusively, it is difficult, if not impossible, to keep control of the position of the film and of the compression in the radial direction of insertion during the wrapping step when the speed increases beyond a certain limit, causing defects in the package which, in any case, can occur also when the speed is kept below said limit.

SUMMARY OF THE INVENTION

There is thus the problem of feeding stacks of paper tissue products that can be compressed in packaging machines like those of the aforementioned type, exceeding the productivity limits currently imposed by the prior art, keeping the correct geometry of the group or stack of products, as well as the control of the compression (in the radial insertion direction) and of the position of the film in the wrapping step, all with constructive solutions that are relatively simple and reliable.

The solution of such a problem is achieved with the apparatus and the method according to the present invention, the essential characteristics of which are defined by the first and by the thirteenth of the attached claims.

BRIEF DESCRIPTION OF THE DRAWINGS

The characteristics and the advantages of the apparatus and method according to the present invention shall become apparent from the following description of embodiments thereof, given as an example and not for limiting purposes, with reference to the attached drawings, in which:

FIG. 4 and FIG. 5 are respectively side and top plan views of an upper oscillating arm of the feeding device of the machine of the previous figures;

FIG. 6 and FIG. 7 are respectively a side and a top plan view of a lower oscillating arm of the feeding device of the machine of the previous figures;

Figure 21:
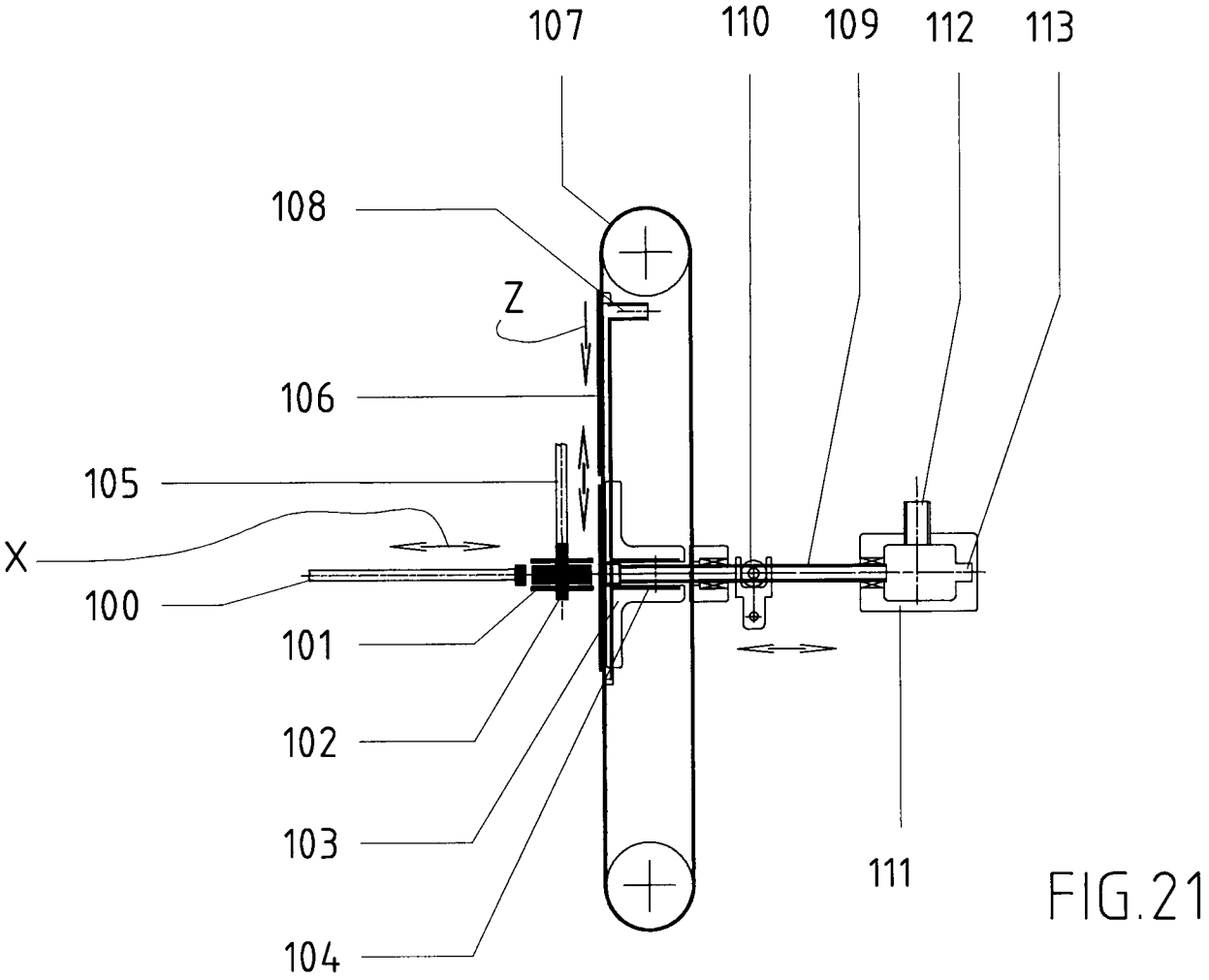
Figure 22B:
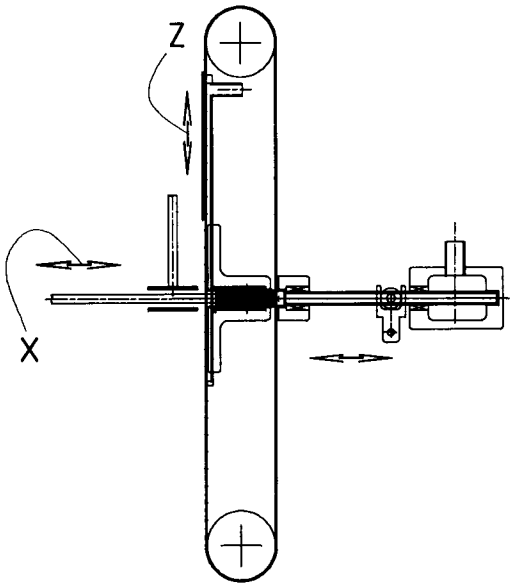
Figure 22A:
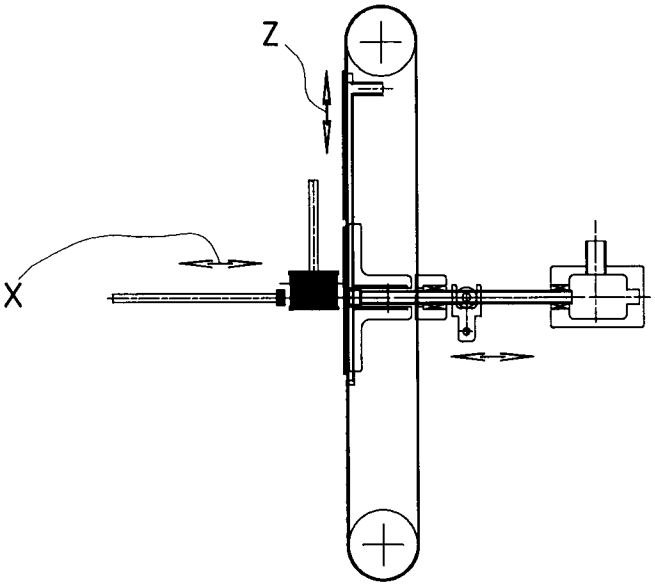
Figure 23:
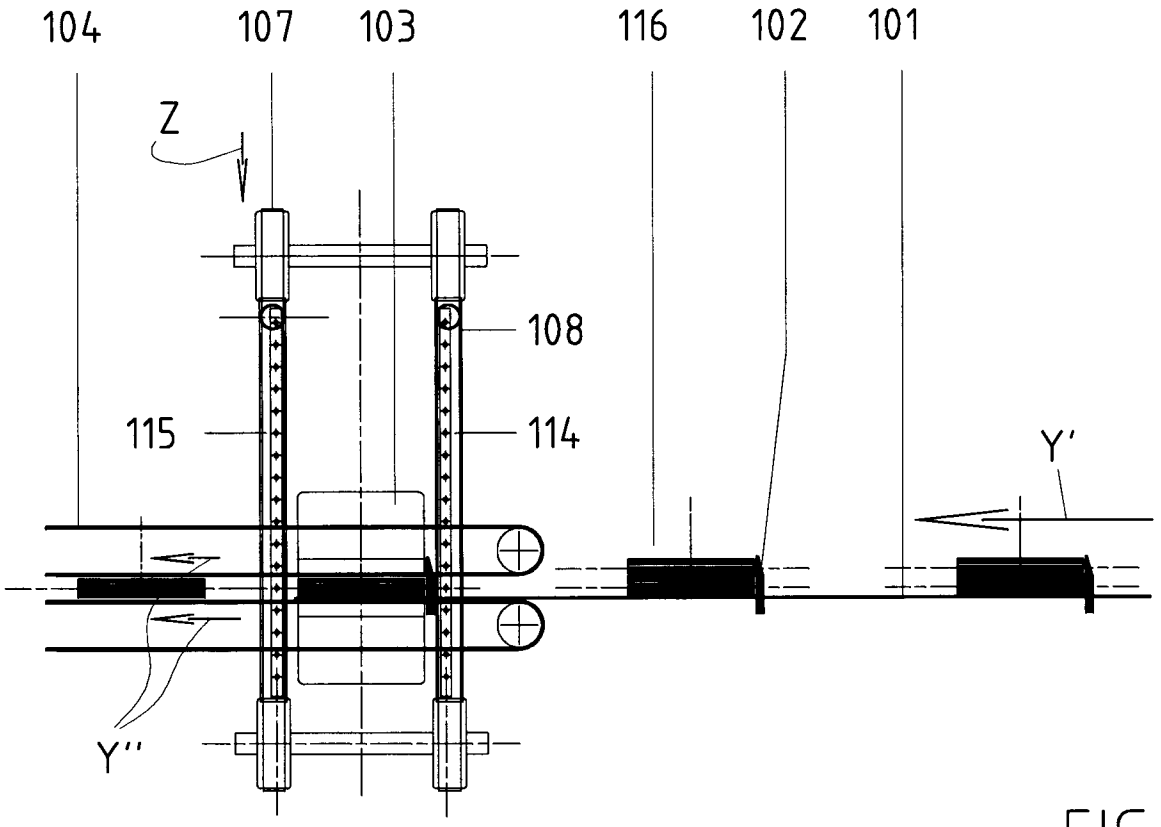

FIGS. from 20*a* to 20*g* are side views of the packaging machine according to the invention in the various operating steps, from the insertion of a stack of products into the compression device to the outlet of the packaged products;

FIG. 21 shows a schematic side view of an apparatus according to a different embodiment of the invention;

FIGS. 22*a* and 22*b* are side views, that have been further simplified, of the apparatus of FIG. 21, in two subsequent operating steps;

FIG. 23 is a front view of the apparatus of FIG. 21; and

Figure 24:
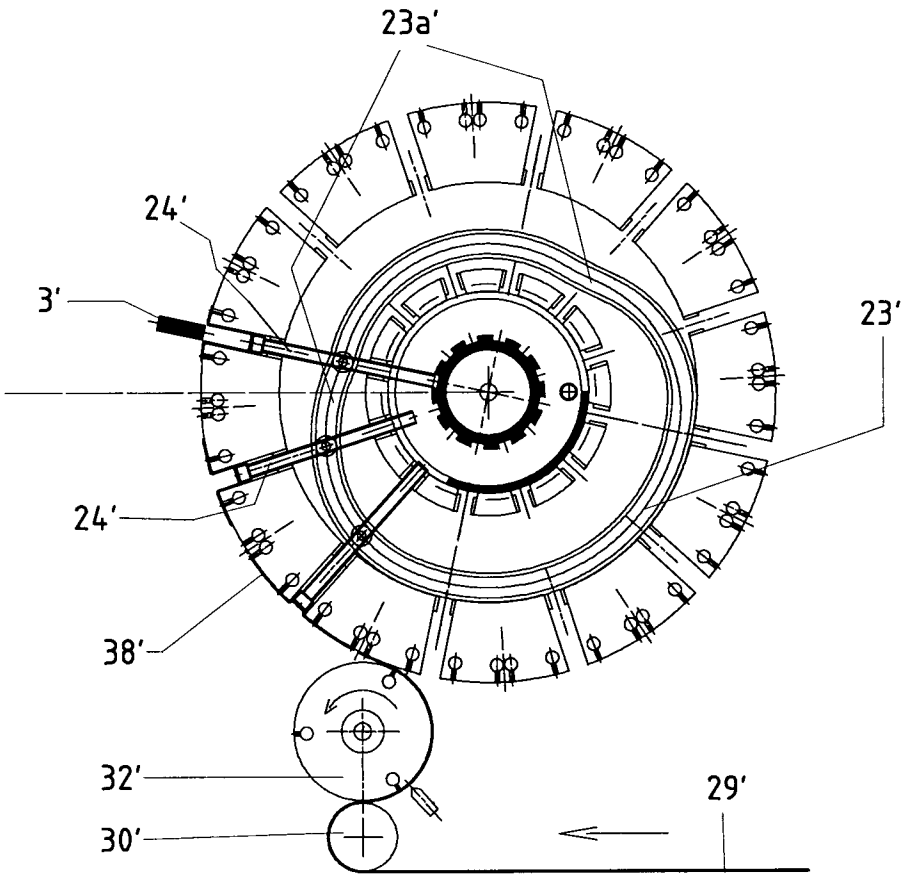

FIG. 24 is a side view of the packaging machine according to the first embodiment of the invention, in an operating step according to a working mode that is different with respect to that shown in the previous figures from 20*a* to 20*g*.

DETAILED DESCRIPTION OF THE INVENTION

Figure 1:
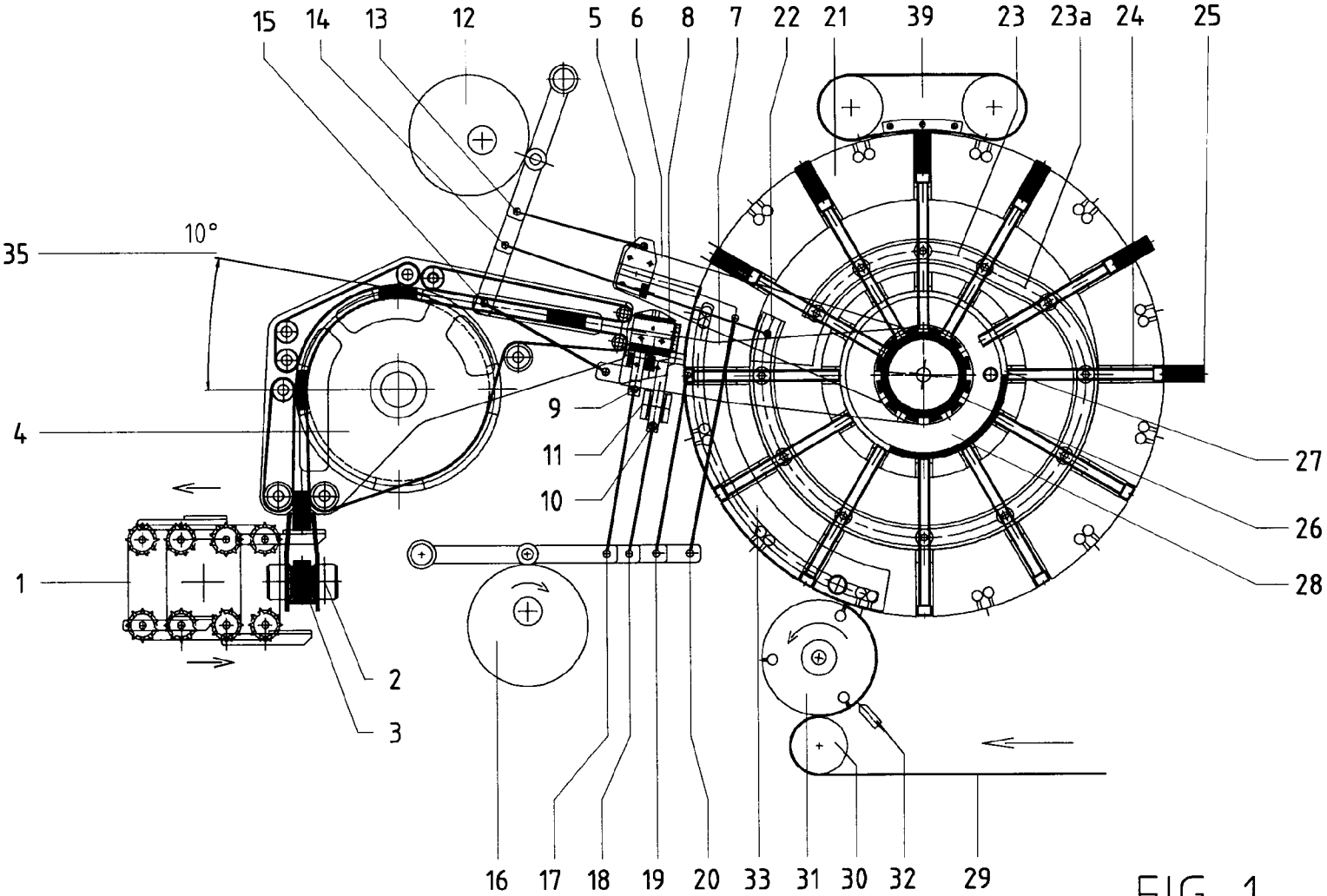
FIG. 1 is a schematic side view of a packaging machine according to a first embodiment of the invention, complete with all its devices.
Figure 1A:
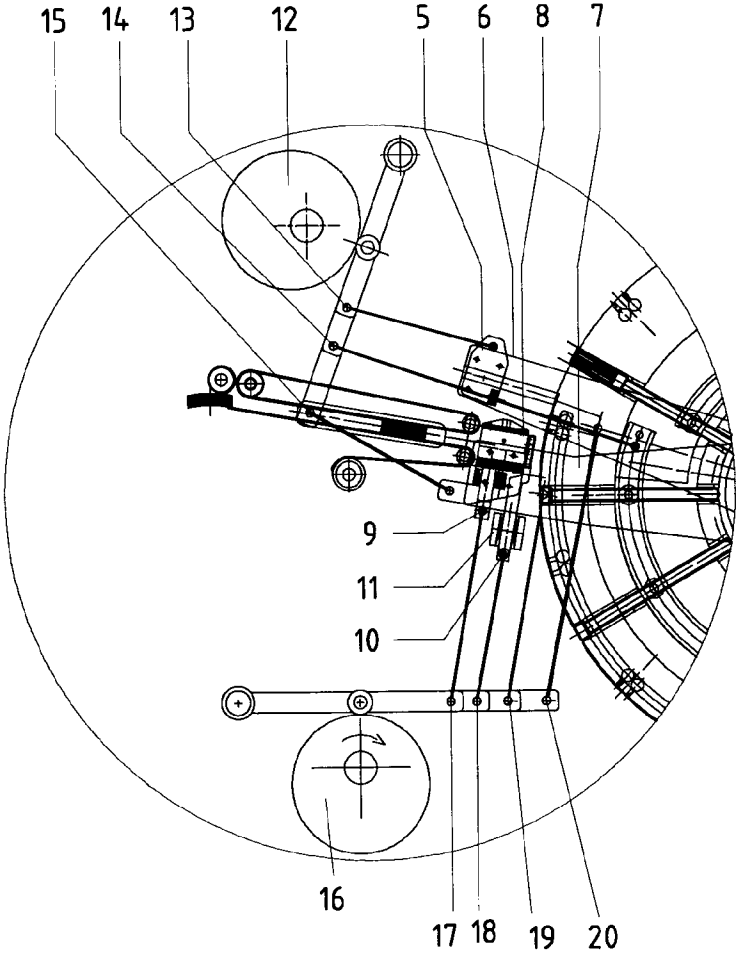
FIG. 1*a* represents an enlarged view of the zone that is circumscribed by the circle I of FIG. 1, with parts removed for the sake of clarity of the illustration.
Figure 3:
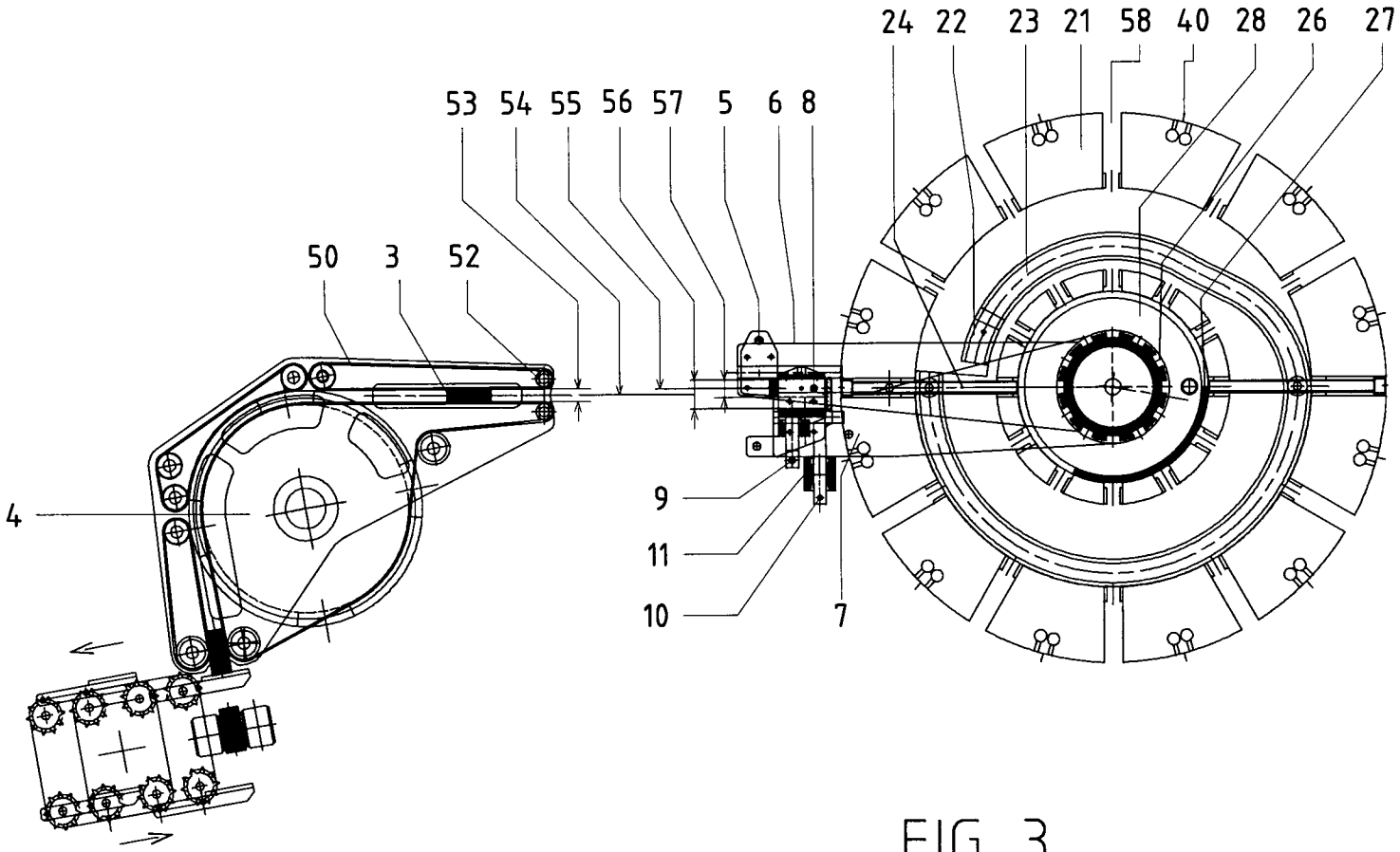
FIG. 3 is a schematic side view like that of FIG. 1 but showing only the devices for feeding, compressing and inserting the stacks and the packaging drum.
Figure 8:
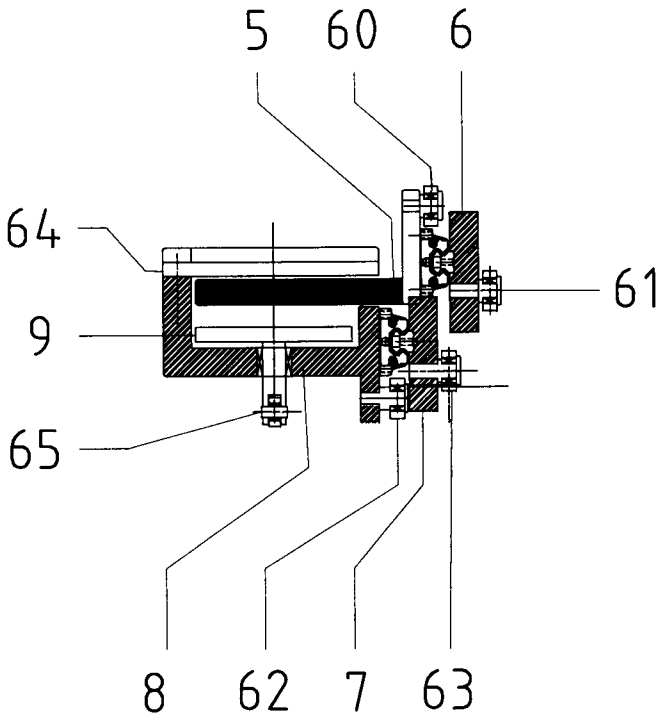
FIG. 8 is a cross-section view of the feeding device, with the upper and lower arms that are sectioned respectively along section lines B and A of FIGS. 4 and 6.

With reference to said figures, and in particular to FIGS. 1, 1*a* and 3, a packaging machine or apparatus according to the invention comprises a device 1 for inserting the product (stacks 3 of folded products to be packaged) into a feeding system. A couple of belts 2, coming from a folding machine upstream, feed the product to the inserting device 1, along a direction that is orthogonal to the drawing sheet, taking here as a reference the way the machine is displayed in the figures.

A device generally indicated with reference numeral 4 is intended for feeding the stacks 3 to a compression device or system 8. The feeding occurs along a plane 35 that is inclined with respect to the horizontal, typically by about 10°. FIG. 3 particularly shows belts 50 for the pre-compression and the feeding of the stacks 3 in the device 4, a couple of deviation rollers 52 of the belts 50 that can be adjusted in height as a function of the product to be packaged, and a stack 3 of products that have been pre-compressed in the insertion step into a compression device 8 arranged downstream.

It can also be noted the provision of: a device 5 for the radial insertion of the stacks 3 in a packaging drum 21 equipped with pockets 58 radially formed with an adjustable width as a function of the product to be packaged; an upper oscillating arm 6 for the insertion of the stacks in the drum 21; and a lower oscillating arm 7 that slidably supports, along its axis, the aforementioned device 8 for compressing the stacks comprising a lower compression plate 9 with a reciprocating motion in a direction that is orthogonal with respect to the axis of the arm 7. A front plate 10 for stopping the stacks 3 is in turn reciprocating along a direction orthogonal to that of the lower arm 7, when it is in the position of bottom dead centre, in this case independently from the same arm. A support 11 of the stop plate 10 is indeed fixedly connected through a linkage 34*a* to a basement 34 of the machine (see FIG. 2).

A multiple cam upper actuation device 12 drives: a first crank and rod upper device 13 for controlling the insertion device 5 of the stacks 3, i.e. to displace the device 5 along the arm 6; a second crank and rod upper device 14 for radially controlling a mobile cam portion 22 intended also, as made clearer hereafter, for inserting the plastic packaging film; and a third crank and rod upper device 15 for controlling the radial displacement, i.e. along the arm 7, of the device 8 for compressing the stacks.

A multiple cam lower actuation device 16 drives: a first crank and rod lower device 17 for controlling the lower compression plate 9 of the stacks 3; a second crank and rod lower device 18 for controlling the front stop plate 10 of the stacks 3; a third crank and rod lower device 19 for controlling the rotation of the lower oscillating arm 7; and a fourth crank and rod lower device 20 for controlling the rotation of the upper oscillating arm 6.

Both cam actuation devices actually provide for a mechanism that comprises an eccentrically rotating disc, peripherally defining a cam surface with which a crank comes tangentially into contact. The crank is hinged at an end, and contacts the cam surface at a crank intermediate point, so that the same crank is driven in oscillation, around the hinging point, in response to the rotation of the disc. The rods linking the cranks to the various controlled devices are in turn pivotally connected, respectively, to the same devices, and to the cranks in predetermined points comprised between the crank intermediate point of contact with the disc, and a free end of the crank, all with geometrical characteristics that are suitably set as a function of the mutually coordinated displacements to be carried out.

The already mentioned mobile cam portion 22 drives extractors 24 that are also designed for assisting the insertion of the film in the pockets 58. More precisely, the mobile portion 22 represents a radially displaceable end portion (as seen driven by the second upper device 14) of a fixed cam 23 evolving according to a curl around the axis of the drum on a side thereof. In practice, the fixed cam 23 of the invention does not run according to a ring, but rather like an open loop, the opening being defined by a circumferential and radial discontinuity (step-like discontinuity) in the film insertion area. The mobile portion 22 is indeed arranged in correspondence with such a discontinuity, and is displaceable radially between a radially external position (guide cam larger diameter) and a radially internal position (guide cam smaller diameter), said displacement driving accordingly the movement of the extractors. In an area 23*a* opposite the discontinuity, the fixed cam 23 then evolves in a continuous manner from the smaller to the larger diameter so as to drive the extractors 24 between a rearward displaced position and a radially extracted position for pushing the packaged stacks 3 out of the pockets 58. The outlet of the packages from the drum 21 is indicated with reference numeral 25, still in FIG. 1.

Again in FIG. 1 it is possible to identify a band of film 29 fed by a cylinder 30 in a continuous manner for packaging the product, and cut in blanks 38 by a cutting cylinder 31 bearing a blade 32; finally, a transversal welding system 39 welds the film once wrapped around the stacks 3.

Figure 2:
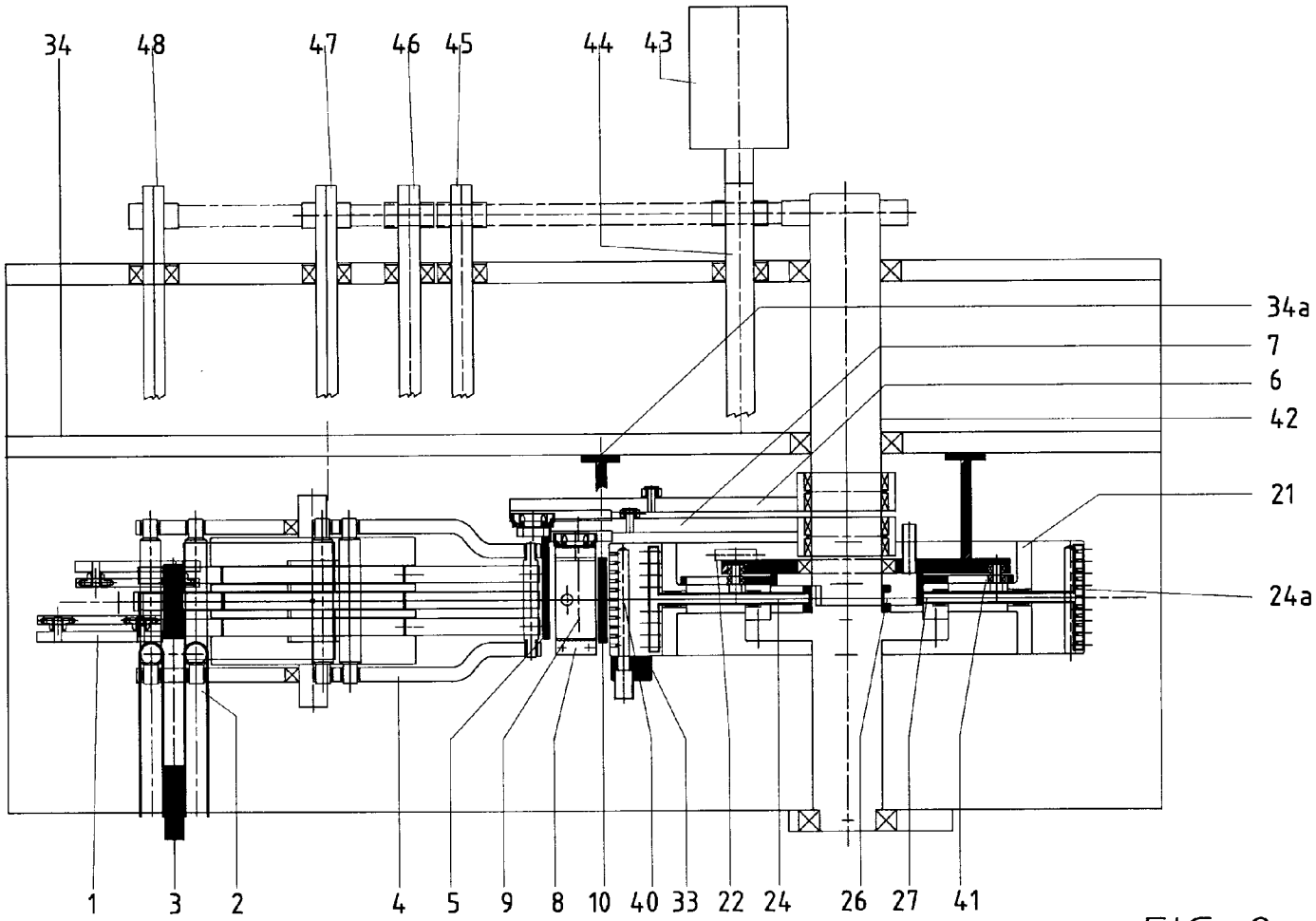
FIG. 2 is a schematic top plan view of the machine of FIG. 1.

With particular reference now to FIG. 2, a series of ducts 40 is formed in the drum 21 for the passage of the depression/suction exerted on the periphery of the same drum. The passages 40 are clearly visible and indicated also in FIG. 3; they communicate with a fixed manifold 33 that circumferentially runs along a certain arc, along which the depression must indeed be sequentially transmitted, drawn from an external vacuum source to the purpose of holding the packaging film. Respective bearings 41 carry out the function of a mechanical drive link with the extractors 24. A transmission shaft 42 connected to the drum 21 is actuated by a motor 43 which also drives a shaft 44 for controlling the film feeding and cutting system. The arms 6 and 7 are coupled with the shaft 42, but idle therewith, adjacent to one another on one side of the drum, and in the same way there is arranged the mentioned cam 23 which is integral with the base 34. The same motor 43 also transmits motion to: a shaft 45 for controlling the upper actuation device 12; a shaft 46 for controlling the lower actuation device 16; a shaft 47 for controlling the stack feeding device 4; and finally a shaft 48 for controlling the stack inserting device 1.

Going back to FIG. 3, reference numerals from 53 to 57 denote various geometrical reference elements for the operation of the machine, according to what shall become clearer further on in the present description. A plane 54 defines the middle of the height 53 of the stacks fed by the device 4, said plane being thus equidistant from the rollers 52, and at the same time the middle of the height or opening 56 of the compression device 8 in the step of maximum opening, during the insertion of the product, at the bottom dead centre of the lower arm 7. A plane 55 moreover corresponds to the middle of the height of compression in the condition of maximum compression and coincides with a diametral plane of the drum 21. The compression height, indicated with reference numeral 57, can of course be adjusted as a function of the product to be packaged.

With particular reference to the figures from 4 to 8, these show in greater detail the group of the upper and lower oscillating arms 6, 7 with the device 5 for the insertion of the stacks, in the form of a bar projecting sideways towards the drum from the upper arm 6 (arranged farthest outside), and the compression device 8 supported cantilevered, again towards the drum, by the lower arm 7 (arranged farthest inside, i.e. adjacent to the drum itself). Obviously, the extension of the arms 6 and 7 is such as to ensure that the devices 5 and 8 face onto the working surface of the drum, i.e. that in which the pockets are formed.

Again in such figures it can be noted a linkage 60 with the first crank and rod upper device 13, a linkage 61 with the fourth crank and rod lower device 20 for controlling the upper oscillating arm 6, a linkage 62 with the third crank and rod upper device 15 for controlling the stack compression device 8, a linkage 63 with the third crank and rod lower device 19 for controlling the lower oscillating arm 7, an upper compression plate 64 that can be adjusted as a function of the height of the pockets of the drum and of the stacks to be packaged, and finally a linkage 65 with the first crank and rod lower device 17 for controlling the reciprocating motion of the lower compression plate 9.

Figure 13:
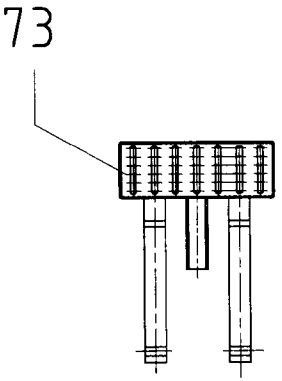
FIGS. 12 and 13 are respectively a side view and a front view of a stop plate cooperating with the device according to the two previous figures.
Figure 12:
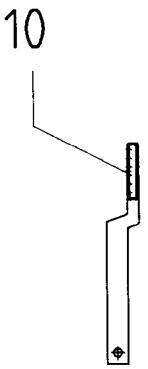
Figure 11:
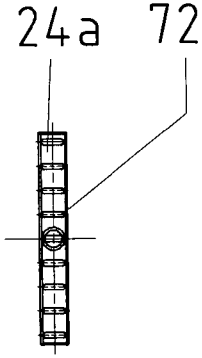
FIG. 10 and FIG. 11 are respectively a top plan and front schematic view of a device for inserting the film and extracting the products.
Figure 10:
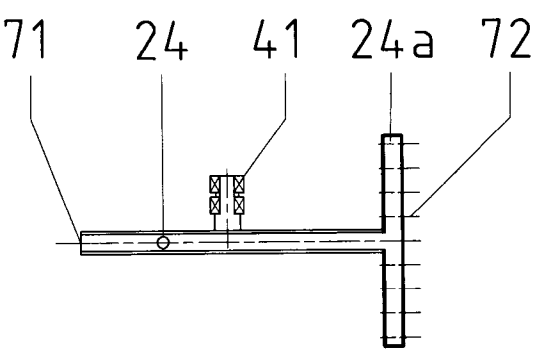
Figure 9:
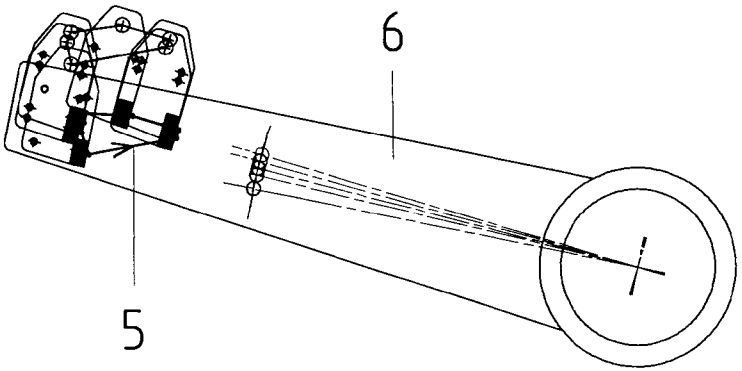
FIG. 9 schematically depicts the movements of the upper oscillating arm of the feeding device in the various operating steps, in side view.
Figure 16:
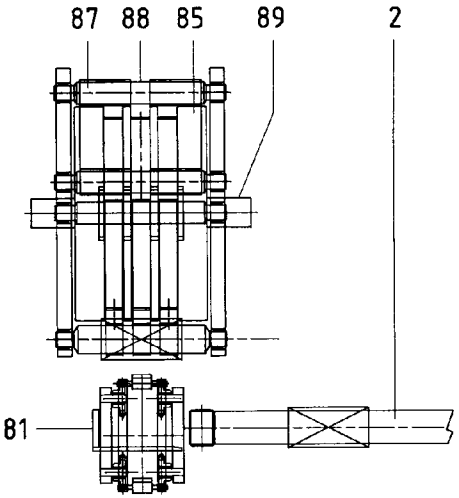
FIGS. 14, 15 and 16 are respectively a schematic side view, a schematic top plan view and a schematic front view of the device for feeding the stacked products, with vertical product inlet.
Figure 15:
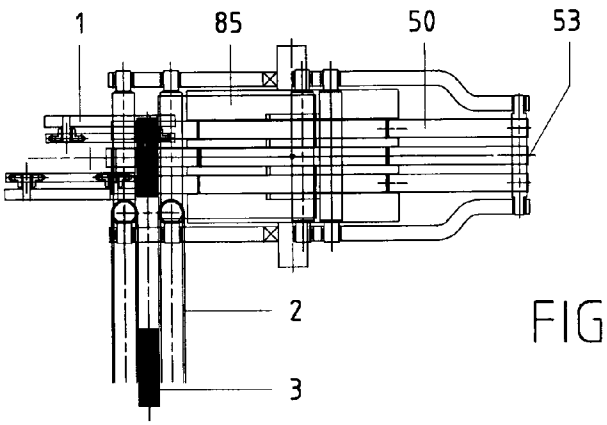

The movement of the upper oscillating arm 6 in the various operating steps is indeed schematised in FIG. 9, together with the various positions correspondingly taken up by the insertion device 5. FIGS. 10 and 11, on the other hand, show more clearly an extractor 24, which, as mentioned above, also performs the function of assisting the insertion of the film 38, with its own bearing 41. In such figures there can to be noted a duct 71 and holes 72 open on a working surface, for the passage of the depression/suction, such a surface being defined by a head 24*a* which represents a stop against which the stacks come into abutment. FIGS. 12 and 13 are, on the other hand, isolated representations of the front stop plate 10 of the stacks 3, and it can be noted how it is in turn provided with holes 73 for the passage of the depression/suction.

Again considering in particular FIGS. 1 and 3, a sequential valve 27 is formed in the drum 21; such valve is fixedly linked with the fixed cam 23 for controlling the depression on the side of insertion of the film. In practice, in the point where the film is fed on the drum 21 by means of the cylinder 31, the aforementioned valve activates the suction exerted by the extractors 24, turning the suction off when the product has been inserted completely, or at about ¾ of the complete insertion run.

A further sequential valve 26 is in the shape of a crown, which is fixedly connected to the shaft 42 with which the drum 21 is integral, and is activated at about ⅔ of the insertion step, as a result of the movement of the extractors 24. When the tail end of the extractors 24 abuts on the bottom of grooves defined by the crown valve 26, the depression exerted by the extractors themselves is turned off. In this way, before the insertion has been completed, due to the depression applied at this point on the end flaps of the blank of film 38 by only the passages 40 of the surface of the drum, there is a return effect of the same film towards the outside with consequent effect of close adhesion to the stack 3.

The valve 26, and in particular the bottom of the relative grooves, can have different diameters to control at which insertion depth one desires to turn the depression off. A depression chamber 28, which transmits the suction to the extractors 24, is fed by a vacuum source normally with values that are about double that applied to the manifold 33, this indeed to ensure a safe positioning of the film during the insertion step.

With particular reference now to FIGS. 14 to 18, a feeding device 4 with vertical inlet thus also comprises a series of stack conveyors 80 linked with a transmission system, a stack front stop plate 81, a series of stack guides 82 for guiding the stacks in the insertion step, a series of belts 83 and 87 outside the periphery of a conveyor cylinder 85 which can rotate integrally with a shaft 89, a series of cavities 84 formed in the cylinder 85, a series of belts 86 inside the cylinder 85, and a plurality of rollers 88 for controlling and deviating the various belts. The groups of external belts, in each of which two or more belts evolve in parallel, thus include three successive series of external belts, i.e. belts 83 opposing the belts 86 along the portion of vertical or almost vertical inlet, for compressing the stacks so as to keep them in position and aligned, the belts 50 which transport the stacks along the outlet portion, and belts 87 in an intermediate deviation zone between the inlet portion and the outlet portion, so as to keep the stacks in position in the passage from the vertical position to the horizontal one, in adherence with the cylinder 85 from which they are driven.

Figure 19:
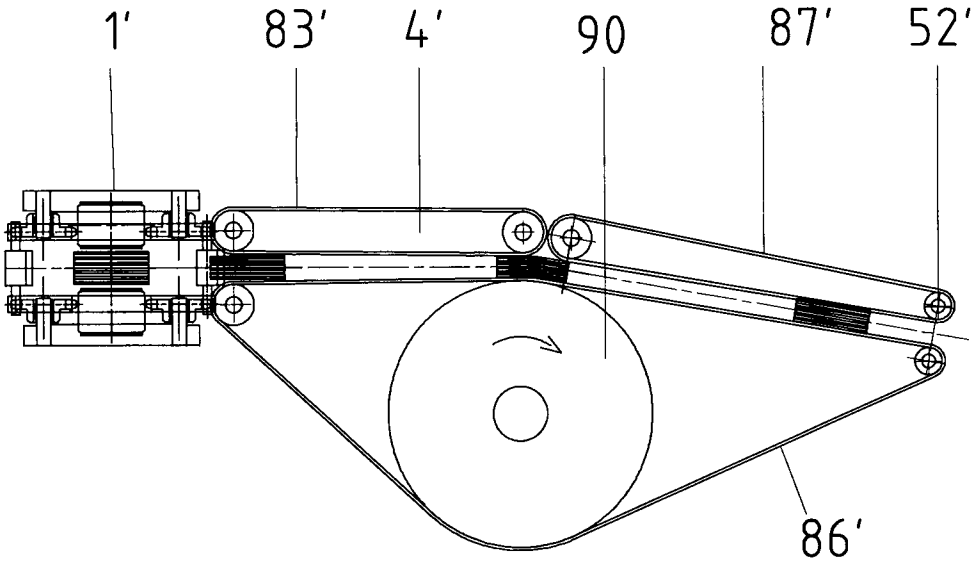
FIG. 19 is a schematic side view of the stack feeding device with a horizontal product inlet.

In FIG. 19 an analogous feeding device with horizontal inlet of the product, according to an embodiment that is alternative to the previous one, has a simplified structure with a feeding cylinder 90 without cavities. In the case in which there is horizontal outlet of the stacks from the folding machine upstream, there is no need for cavities since the belt deviation angle is reduced.

With reference now also and in particular to FIGS. 20*a* to 20*g*, the machine according to the invention operates in the following manner.

As mentioned, the machine can be arranged for vertical or horizontal feeding, and in any case for a good operation the insertion plane 35 must have a certain inclination with respect to the horizontal, descending towards the drum 21 and preferably equal to about 10°. In such a way the stacks 3, as shall be comprised more clearly hereafter, adhere to the front stop plate in perfectly perpendicular arrangement with respect to the plane defined by the lower compression plate 9.

Figure 14:
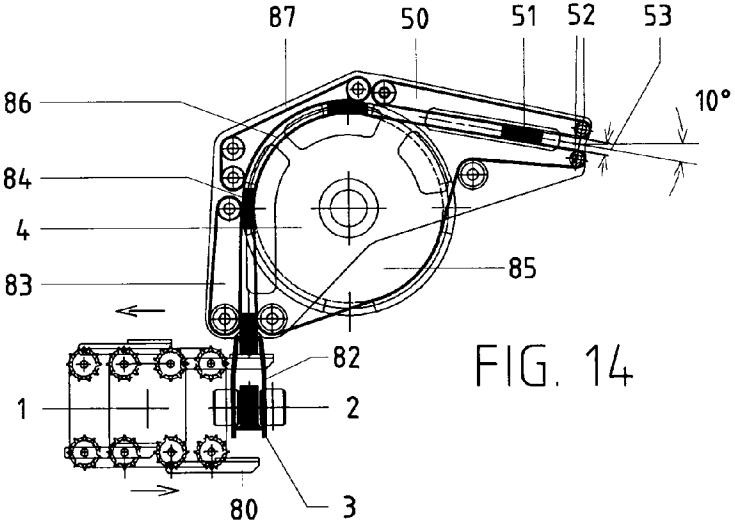
Figure 18:
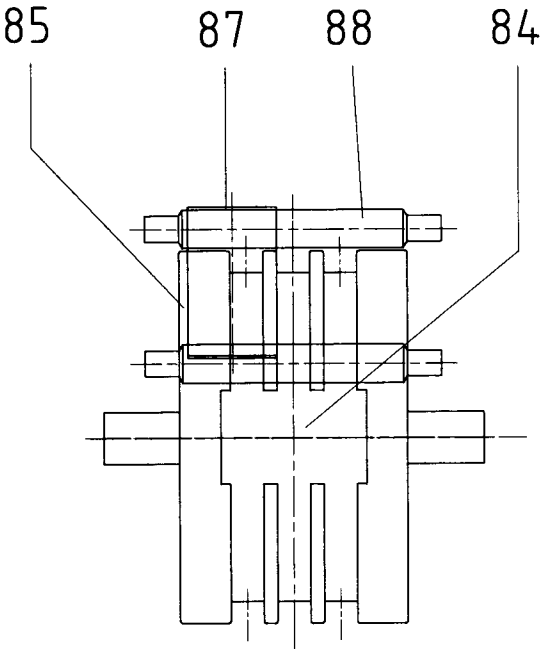
FIG. 17 and FIG. 18 are a side view and a front view of a feeder cylinder of the stacks of products, belonging to the feeding device according to the previous figures.
Figure 17:
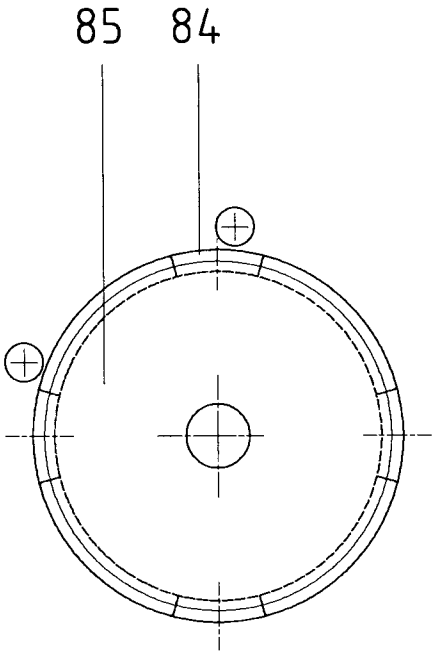
Figure 20A:
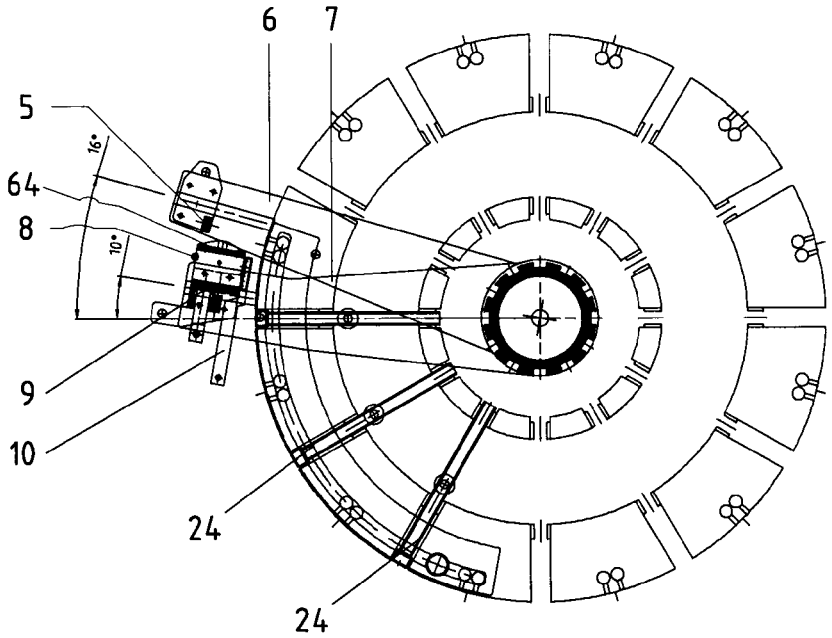
Figure 20B:
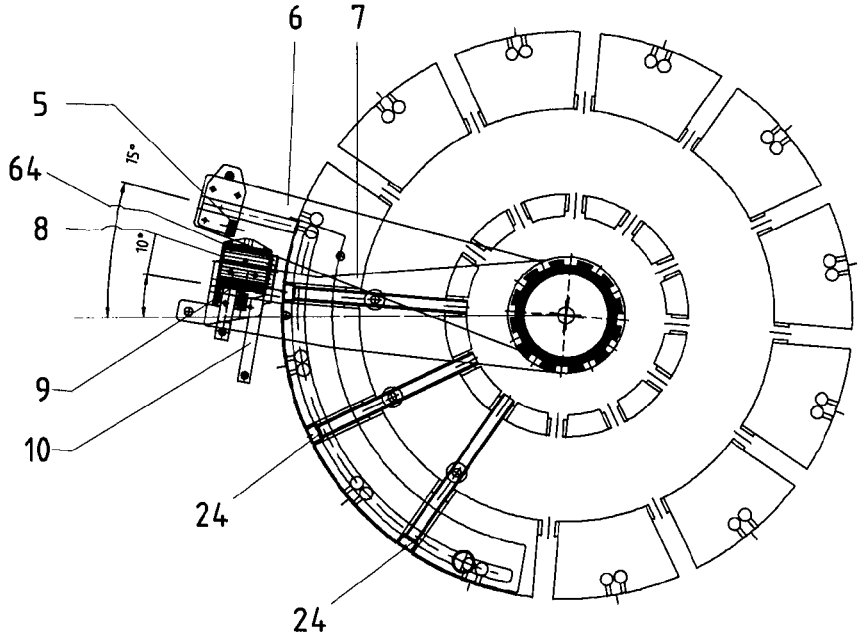

Starting from the step shown in FIGS. 1, 14 and 20*a*, the product stacks 3 are fed by the belts 2, and at the end of their path they are inserted in the product guides 82 in adherence with the stop plate 81. The insertion feet 80 have a continuous vertical and horizontal movement with constant speed equal to that of the belts 83 and 86 driven by the cylinder 85 of the feeding device 4, said belts 83, 86 receiving each stack by engaging with it at opposite ends, and also carrying out a slight compression. The stacks in forward displacement movement reach the cavities 84 formed in the cylinder 85, and after the detachment from the belts 83 they are kept compressed towards the cylinder 85 through the further outer belts 87 which are driven by the same cylinder through friction with its surface. In such a way the correct peripheral speed is maintained without causing the stacks themselves to become deformed.

When the stacks come out from the cylinder 85, the belts 50 in cooperation with the internal belts 86 transport the stacks to their insertion in the compression device 8. The outlet rollers 52 of the belts 50 and 86, as already mentioned, have an adjustment system for keeping an equidistant position with respect to the middle plane 54 as a function of the height of the product to be packaged. The speed of the belts can vary according to the diameter of the cylinder 85 and to the number of cavities 84 present in the cylinder itself. The stacks in outlet from the belts 50, 86 have a compressed height that is about the same as that of the packaged product, and are inserted into the compression device 8 in its condition of maximum opening 56 at the bottom dead centre of the arm 7. Such a height 56 is normally 50% greater with respect to the height of the stacks in outlet from the belts 50, 86.

When it is inserted in the compression device (FIG. 20*b*) the stack expands and becomes adherent with the stop plate 10 which exerts a suction (holes 73) ensuring the perfect alignment with the plate itself even of the single folded sheets of paper, before the compression.

Figure 20C:
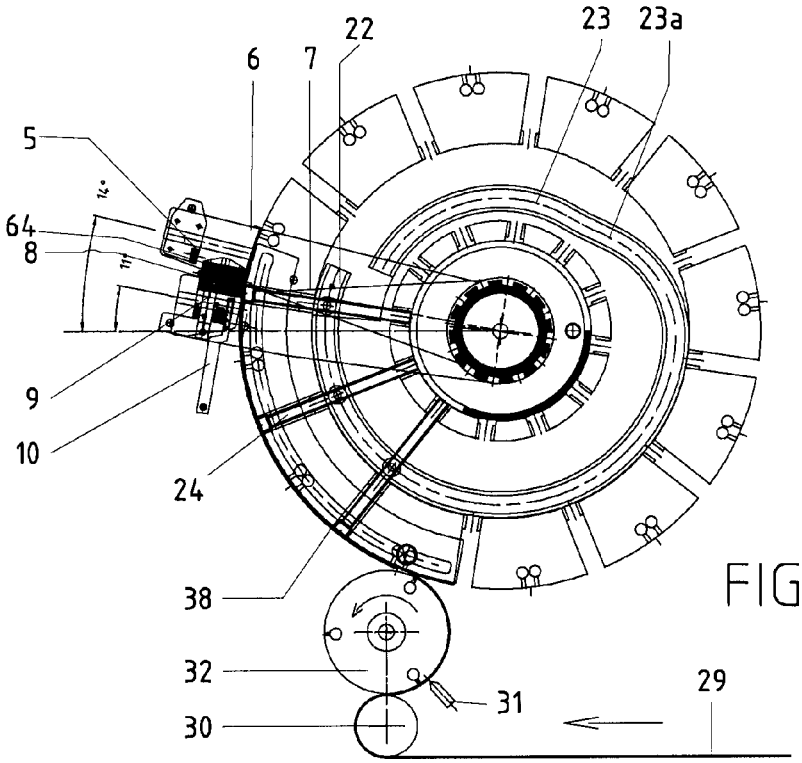

FIG. 20*c* represents the beginning of the compression step. The arm 7 begins its ascending movement, with the compression plate 9 which, having a relative movement that is orthogonal with respect to the arm 7, arrives at the programmed height and compresses the stack in cooperation with the upper plate 64. Such a programmed height of course coincides with the height of the pockets 58 of the packaging drum 21 and is maintained until the stack is completely inserted inside the drum.

The front stop plate 10, in turn capable of a movement which is orthogonal with respect to the lower arm 7 in the lower end stop position, meanwhile reaches and then keeps its own lower end stop position. At this point the compression device linked to the arm 7 in the condition of maximum compression of the stack carries out a radial displacement along the axis of the same arm until it gets close to the drum 21

The upper arm 6, in the meantime, has begun and continued a descending step, rotating around the axis of the drum 21, until it reaches the bottom dead centre; then the movement is reversed and an ascending step begins.

Figure 20D:
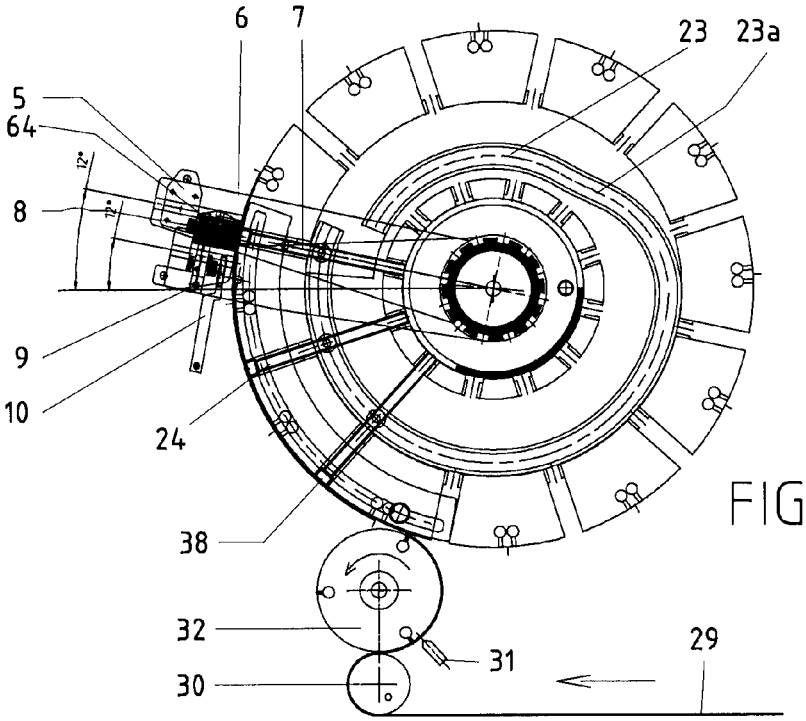

Passing on to FIG. 20*d*, the arms 6 and 7 have reached a mutual alignment position that is suitable for allowing the insertion of the stack in a pocket 58 of the drum 21, and at this point the insertion device 5, with a radial movement, moves toward the drum until it abuts against the stack of compressed product. Once a position in which the distance from the periphery of the drum corresponds to the width of the stack has been reached, the mobile cam portion 22 also begins a radial movement, i.e. a rearward displacement, accompanying the product in a coordinated manner with the device 5, so as to keep it orderly secured on two opposite sides, until it has been completely inserted.

Figure 20E:
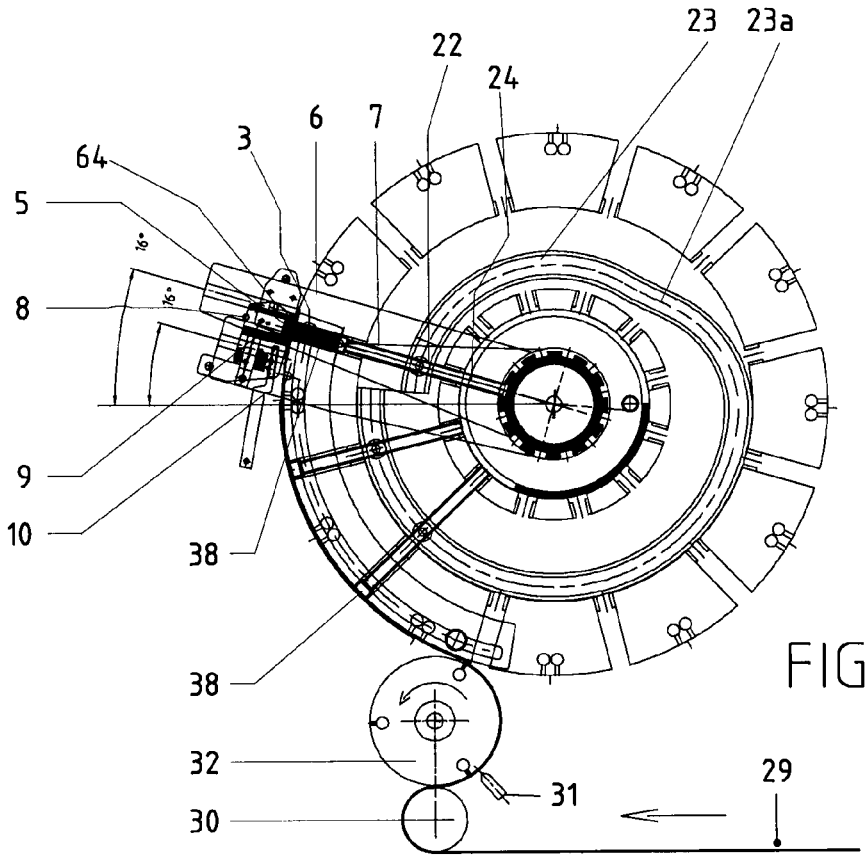

FIG. 20*e* shows the insertion step of the stack 3 with the arms 6 and 7 that rotate in phase with one another and with one of the pockets 58 of the drum 21. The device 5 proceeds forwards until the stack 3 is completely inserted; in adherence with the stack, by means of the passages 40 connected to a depression source, a blank of film was previously interposed so as to carry out the wrapping, according to a conventional expedient but with some peculiar provisions of the present invention which will result clearer hereafter. The front stop plate 10 returns to its initial condition.

Figure 20F:
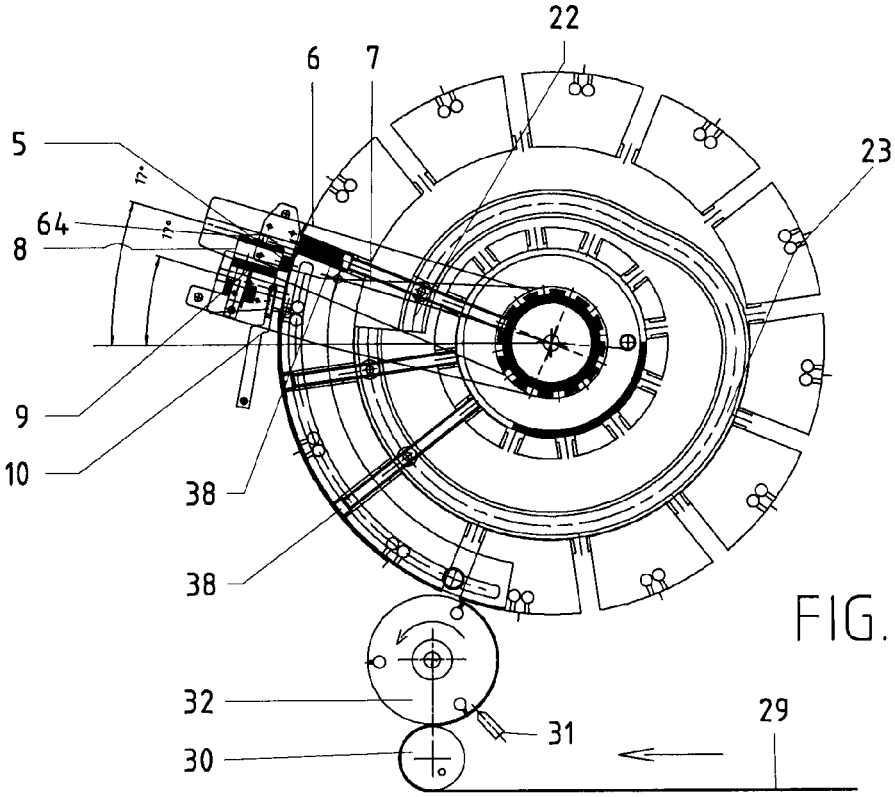

Passing on now to FIG. 20*f*, the upper arm 6 continues to rise towards the top dead centre, the insertion device 5 keeps its position closest to the drum 21, and the arm 7 reaches its top dead centre. The compression device 8 carries out a radial abrupt movement away from the drum, until it returns to the starting position, so as to free the space between the upper compression plate 64 of the device 8 and the insertion device 5.

Figure 20G:
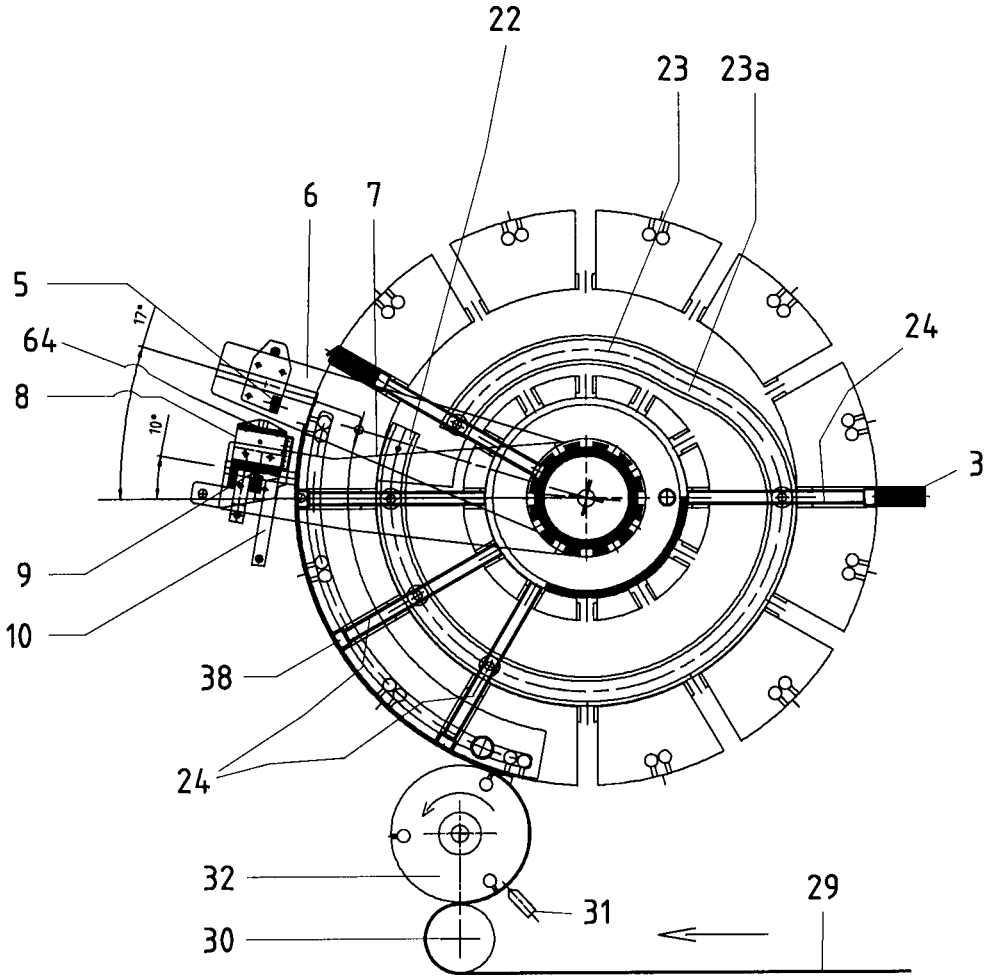

Finally, as can be seen in FIG. 20*g*, the lower arm 7 and the compression plate 9 carry out a return movement to the starting position so as to receive a new stack of products. The upper arm 6 arrives at the top dead centre and inverts its movement, whereas the insertion device begins its radial movement along the arm 6 so as to return to the starting position, without interfering, as already mentioned, with the upper compression plate 64 which, being part of the device 8, is already in position to receive a new stack 3. The drum 21 continues its rotation with constant speed, in a clockwise direction according to the representation of the figures, and a new packaging pocket 58 proceeds to the point in phase with the arms 6, 7. The system is ready for a new cycle.

Returning to follow the path of the stacks inside the drum 21, it should be noted that the control of the stacks, with the film wound in the pockets, is also taken up by the extractors 24 which, due to the movement of the cam portion 22 in the area of insertion, move rearwards thus providing an inner side abutment accompanying the same stacks in their insertion displacement.

Moreover, the suction exerted by the extractors 24 contributes to keep the stack and the wrapping film in an orderly fashion. When the packet passes in correspondence with the welding system, it is welded and then expelled thanks to the ejection of its extractor driven by the evolution 23*a* of the cam 23 in the area diametrically opposed to that of insertion. The control of the suction/depression exerted by the extractors 24 is synchronised along the appropriate rotation angle of the drum, by means of the valves 26 and 27.

With reference now to figures from 21 to 23, a configuration of a simplified apparatus to which the invention can be applied, comprises a pusher 100 of the stacks of products, operating along an insertion direction X. A plurality of product guides 101, with a series of thrusting feet 102 provided with a continuous movement and to this purpose fixedly connected to chains or belts which are not shown, guide the stacks in a feeding direction Y' orthogonal with the direction X, so as to place them in the working area of the pusher. A packaging pocket 103, in this case a stationary one, with dimensions that are suitable for the product to be packaged, receives the stacks thrusted by the pusher 100 along the direction X Conveyor belts 104 with a discontinuous movement (i.e. they are stopped in the insertion step) are associated to the internal surfaces of the pocket 103 in order to free the pocket from the packaged stack, along an outlet direction Y" parallel and on the same plane as the feeding direction Y'. A system for compressing the stacks 105 can also be noted, operating in the working area of the pusher, before the same comes into action. Stacks 116 of products to be packaged, before the compression, are represented in FIG. 23.

Segments of film 106 suitably cut according to the product to be packaged are fed to the pocket 103 along an inlet direction Z, orthogonal to the plane defined by the directions X and Y' (or Y"). This is carried out through suction by a couple of belts 107, suitably perforated and in pneumatic association with a couple of perforated manifolds 108 which are adherent to the same belts and connected to a depression source that is not represented. The perforations of the belts and of the manifolds are visible in particular in FIG. 23, indicated with numerals 115 and 114.

An extractor 109, having characteristics and operation that are the same as those of one of the extractors 24 already described for the first embodiment, is intended to accompany the stacks of product, on the side opposite with respect to that on which the pusher 100 acts, as they enter the pocket 103. To such a purpose, besides being provided with passages for the depression, the extractor 109 is associated with a carriage 110 which drives its movement synchronised with the pusher 100. The pneumatic system that feeds the extractor 109 can in particular include a chamber 111 connected to the external depression source through a passage 112, and a sequential valve 113, in the shape of a cavity with which a tail of the extractor engages at the rear end stop, so as to obstruct the suction passage and thus allow the detachment from the film-wrapped stacks inside the pocket 103. The stacks then become free to be transported in outlet by the discontinuous moving belts 104.

It should be clear that, although indicated as "extractor" for the sake of coherence with the previous embodiment, in this case the device 109 only carries out the function of orderly stopping and accompanying the product into the pocket 103, whereas the extraction is indeed carried out by the transport system 104, which leads the product to further downstream systems for folding the film and welding the front part of the packet, of the known type and not shown.

The operation of the device as a whole is made further clear, in addition to what has already been described for the previous embodiment, by considering FIGS. 22*a* and 22*b*, which in particular refer to the loading step of a new stack 115 and to the insertion step of the stack in the pocket 103, respectively.

The invention offers then a plurality of advantages. The feeding system through belts, which can have variable speed according to the diameter of the drum, ensures a high feeding speed while keeping the phase control of the position of the product, with short insertion time of the stacks in the compression device, with respect to a chain system, due to its capability not to cause the product to slow down. There is also the possibility of vertically or horizontally feeding the stacks, with pre-compression of the stacks before the insertion in the actual compression device so as to limit the width of the movement of the arms 6 and 7, consequent constructive simplification.

The stack stop plate 10, fixedly connected to the basement, with its depression system, for perfectly aligning the stack itself, is in turn capable of ensuring a significant improvement of the insertion operations, for speed, precision and constructive optimisation. The extractor which accompanies the insertion of the stack in the pocket with precise control of the position of the film, through connection to the depression source, also represents a new and extremely advantageous characteristic in relation to the quality requirements of the packaging for these types of soft and stacked products. Indeed, the stack of products is always kept in an orderly manner between the insertion device and the extractor, during the entire transfer inside the pocket, and it is indeed thanks to such an uninterrupted containment on both sides that deformations, dispersion and material obstruction are avoided.

Moreover, the suction carried out by the extractor on the film previously spread out in contact over the drum (or over the belts of the second embodiment, and in any case over the surface on which the pocket opens), ensures that the stack encounters no resistance and does not suffer impacts by the film at the moment of insertion, and also thanks to this the correct geometry of the product is not put at risk. Concerning this, as shown in FIG. 24, relative to the first embodiment (same or corresponding parts are indicated with same reference numerals as before, provided with an apostrophe), a possibility which can theoretically be implemented, without the advantage offered by the containment of the stack on the inner side of the pocket but in any case interesting for the constructive simplicity and for the total elimination of any impact with the film, contemplates that the extractor comes into operation, moving rearwards for part of its run or even for the complete run, with a certain advance with respect to the insertion means (being in any case coordinated therewith). In such a way the stack enters the pocket with the film already arranged inside, folded and ready to carry out the wrapping.

This constructive simplification is a consequence of the elimination of the mobile cam portion 22, which is no longer necessary; accordingly, there is provided a fixed cam 23' evolving in a continuous annular fashion with two progressive variations in diameter, or evolutions, 23*a*' which control, when suitably designed, the movement of the extractors moving rearward and forward (extraction).

More generally speaking, the results achieved with the invention are due to the overall design (structure and kinematism) of the compression and insertion systems, with—among other things—precise control of the axial compression of the stack by means of the insertion device 5, in cooperation with the extractor 24 and the mobile cam portion 22 (in the first embodiment).

The vertical/horizontal spatial references used above are of course to be interpreted in relation with the most typical operative configuration, and to the orientation represented in the figures, but it is clear that they must not take up any limitative connotation.

The present invention has been described thus far with reference to its preferred embodiments. It should be understood that other embodiments can exist which pertain to the same inventive core, within the scope of protection of the attached claims.

The invention claimed is:

1. An apparatus for packaging stacks of folded tissue products or the like with blanks of plastic film, the apparatus comprising: at least one pocket; an insertion device for inserting a single stack in said pocket, along an insertion direction, with the interposition and consequent folding of a corresponding blank, said pocket being operatively associated with stop means for stopping the stack completely inserted within said pocket, the apparatus further comprising control means for driving said stop means along said insertion direction in a coordinated manner with respect to the operation of said insertion device, and wherein said stop means comprise suction means adapted to keep hold of said film, and to hold off the same film at least in an extraction step wherein the stack is extracted from the pocket and wherein said control means are adapted to drive said stop means in a simultaneous manner with respect to said insertion device in order to provide an abutment to said stack during the whole insertion step in the pocket.

2. The apparatus according to claim 1, wherein said stop means are reciprocatingly movable, moving in said insertion step between a forward displaced position, wherein a stop end is in correspondence to an inlet of said pocket, and a rearward displaced position, wherein said stop end provides an abutment to said stack completely inserted in said pocket.

3. The apparatus according to claim 2, wherein said stop means are associated with valve means adapted to obstruct said suction means for removing the film holding effect when said stop means approach said rearward displacement position.

4. The apparatus according to claim 3, wherein said stop end is defined by a head on which a plurality of suction holes is formed, said suction means also comprising a passage adapted to place said holes in communication with a vacuum source arranged downstream of said valve means.

5. The apparatus according to claim 4, wherein said valve means comprise fixed blocking means on which an end of said stop means opposed to said head abuts, in said rearward displaced position, so as to close said passage.

6. The apparatus according to claim 5, comprising a plurality of said pockets radially formed in a revolving drum, said movable stop means comprising a plurality of respective extractors slidably supported within said drum in order to have reciprocating motion, in a radial direction, said control means comprising fixed guide cam means formed at a side of said drum and with which said extractors engage, said cam means evolving according to an open loop with a step discontinuity in a zone corresponding to that in which said drum is positioned in said insertion step, said cam means having an end portion radially displaceable between an external position and an internal position so as to provide a corresponding drive, in turn, to one of said extractors between said forward displaced position and said rearward displaced position.

7. The apparatus according to claim 6, wherein said valve comprises a crown-shaped body defining grooves on which rearward ends of said extractors are adapted to abut in said rearward displaced position so as to close said suction means, said crown-shaped body being supported by a transmission shaft with which said drum is integral.

8. The apparatus according to claim 6, wherein suction means are formed in said drum for holding said film blanks at opposed flaps, said suction means of the extractors being operated so as to exert a suction greater, preferably about double, with respect to said suction means of the drum.

9. The apparatus according to claim 8, wherein said suction means of said drum are controlled by a fixed sequential valve adapted to activate the suction from a feeding point of the film on the drum to an outlet area following completion of the insertion step.

10. The apparatus according to claim 4, wherein said stop means have a reciprocating motion, along said insertion direction, with respect to a stationary pocket, extraction means of said stacks from said pocket comprising conveyor belts with a reciprocating motion associated with internal surfaces of the pocket in order to free the same pocket from the packaged stack, along an outlet exit direction orthogonal with said insertion direction.

11. The apparatus according to claim 10, comprising feeding means of the film along a direction orthogonal with said insertion direction and with said outlet exit direction.

12. The apparatus according to claim 11, wherein said feeding means of the film comprise at least one couple of perforated belts associated with suction means, said suction means of said stop means being fed so as to exert a suction that is greater with respect to said suction means of the belts.

13. The apparatus according to claim 11, wherein said feeding means of the film comprise at least one couple of perforated belts associated with suction means, said suction means of said stop means being fed so as to exert a suction that is about double with respect to said suction means of the belts.

14. The apparatus according to claim 2, wherein said stop means are associated with valve means adapted to obstruct said suction means for removing the film holding effect when said stop means approach said rearward displacement position at about ⅔ of the rearward displacement run.

15. A packaging method of stacks of folded tissue products or the like with blanks of plastic film, wherein a single stack is inserted, along an insertion direction, in a pocket with the interposition and consequent wrapping of a corresponding blank, the pocket being operatively associated with stop means adapted to stop the stack at least when this is completely inserted within said pocket, wherein said stop means are driven in a coordinated manner with respect to the insertion of the stack in the pocket, wherein the stop means keep hold of the film through suction until it is partially or totally inserted in the pocket, holding off the same film at least in an extraction step of the stack from the pocket, the stop means being driven simultaneously with the insertion of the stack, exerting an abutment action on the stack during the whole insertion step of the same into the pocket.

* * * * *